US012044451B2

(12) United States Patent
Itani

(10) Patent No.: US 12,044,451 B2
(45) Date of Patent: Jul. 23, 2024

(54) SYSTEM AND METHOD FOR SUPERHEAT REGULATION AND EFFICIENCY IMPROVEMENT

(71) Applicant: Mohamad Yehia Marwan Itani, Beirut (LB)

(72) Inventor: Mohamad Yehia Marwan Itani, Beirut (LB)

( * ) Notice: Subject to any disclaimer, the term of this patent is extended or adjusted under 35 U.S.C. 154(b) by 0 days.

(21) Appl. No.: 18/236,323

(22) Filed: Aug. 21, 2023

(65) Prior Publication Data

US 2023/0392842 A1 Dec. 7, 2023

Related U.S. Application Data

(63) Continuation of application No. 16/941,946, filed on Jul. 29, 2020, now Pat. No. 11,732,940.

(60) Provisional application No. 63/025,651, filed on May 15, 2020.

(51) Int. Cl.
*F25B 49/00* (2006.01)
*F25B 40/06* (2006.01)

(52) U.S. Cl.
CPC ..... *F25B 49/005* (2013.01); *F25B 40/06* (2013.01); *F25B 2341/064* (2013.01); *F25B 2400/0401* (2013.01); *F25B 2400/0419* (2013.01)

(58) Field of Classification Search
CPC ..... F25B 40/04; F25B 2400/0419; F25B 2400/0405
See application file for complete search history.

(56) References Cited

U.S. PATENT DOCUMENTS 4,106,307 A * 8/1978 Matsuda ..... F24F 3/001 62/503
2009/0100849 A1* 4/2009 Nishimura ..... F25B 49/005 62/149

* cited by examiner

*Primary Examiner* — Schyler S Sanks
(74) *Attorney, Agent, or Firm* — Bell Nunnally & Martin LLP

(57) ABSTRACT

A refrigeration system includes a heat exchanger configured to provide superheat control for the low temperature low pressure gas refrigerant flowing out of the evaporator and through the first side of the heat exchanger by transferring heat from the high pressure high temperature superheated gas refrigerant flowing through a second side of the heat exchanger. A modulating solenoid valve is located at the inlet of the second side of the heat exchanger and configured to modulate the flow of high pressure high temperature superheated gas refrigerant flowing through the second side of the heat exchanger. A temperature sensor is located in such a way as to measure the temperature of the gas refrigerant flowing out of the evaporator and through the first side of the heat exchanger. A controller is configured to calculate the superheat of the gas refrigerant based on the measured temperature and measured pressure of the gas refrigerant and may compare the calculated superheat to a superheat threshold. If the calculated superheat is less than the superheat threshold, the controller will modulate the flow the high pressure high temperature gas refrigerant flowing through the second side of the heat exchanger. The refrigeration system may be activated in a variety of methods by appropriate control of the valves and other system components.

12 Claims, 8 Drawing Sheets

SYSTEM AND METHOD FOR SUPERHEAT REGULATION AND EFFICIENCY IMPROVEMENT

This patent application is a continuation of U.S. patent application Ser. No. 16/941,946, filed Jul. 29, 2020, which claims priority to U.S. Provisional patent application Ser. No. 63/025,651, filed May 15, 2020, both of which are incorporated herein by reference.

BACKGROUND

Technical Field

This invention relates generally to air conditioning systems, and more particularly, to systems and methods for superheat regulation and efficiency improvement refrigeration vapor compression systems.

Background

Heating and air conditioning systems are well known and have been used in commercial and residential settings for many decades. In the vapor compression cycle, the superheat temperature has an influence on the efficiency of the system and the stability and durability of the compressor. Extensive scientific development and ongoing research has been dedicated to the field of superheat control for vapor compression refrigeration systems. Superheat is defined as the difference between the temperature of the refrigerant flowing out of the evaporator and the saturation temperature of the refrigerant passing through the evaporator. A low superheat value indicates that the refrigerant leaving the evaporator is close to the saturation point and might still contain some liquid refrigerant, while a high superheat value indicates that the refrigerant flowing out of the evaporator has completely transformed into a vapor. These values are important because the efficiency of the system depends on the portion of potential refrigerating capacity of the evaporator that is used to heat the gaseous refrigerant versus evaporate liquid refrigerant.

The reason why the refrigerant under lower pressure is superheated at the outlet of the evaporator in refrigeration systems is that the compressor could be damaged if the refrigerant in its liquid state were drawn by suction into the compressor without being transformed into a completely gaseous state in the evaporator by heat exchange due to a variation in the system load.

Superheat regulation in refrigeration equipment based on the vapor compression cycle is often achieved by a metering device such as thermostatic expansion valve (TXV) or electronic expansion valve (EEV). Regulating superheat has been a perennial problem for heating, ventilation, air conditioning, and refrigeration (HVAC & R) applications. When this control is performed with a mechanical metering device, such as a TXV, a well know problem is the oscillatory behavior at non-design conditions, called hunting. This phenomenon was shown to be a result of the interplay between actuator and the evaporator dynamics. Adoption of EEVs allowed for automatic control techniques such as proportional integral derivatives (PID) to be applied to the evaporator, with improved performance over TXV.

In one typical device known in the art, a system superheat level is maintained by dynamically adjusting the individual superheat setting of a plurality of evaporator coils connected to the system. To achieve this, an EEV valve is opened or closed during the refrigeration system operation to allow either more or less liquid refrigerant to flow into the evaporator coil to maintain a specified level of superheat for optimal utilization of the evaporator coil heat exchanger surface area based on control limits established for the particular system. Though this approach utilizes a dynamic superheat set point for the system, the system still fails to maximize system performance under certain conditions.

Controlling superheat becomes more challenging during periods of system unbalance (e.g., low loads), when temperatures and pressures become unstable. For example, in a "Chilled Water Primary Variable System," the flow at the evaporator is controlled by load demand. If the system load is too low, then the heat transfer operation at the evaporator will produce low heat transfer values which will lead to low superheat temperature that will affect the state of refrigerant entering the compressor. Despite the role of the expansion valve to control the superheat temperature to avoid the above case, expansion valves have values which cannot be exceeded.

In light of the shortcomings of the above, there is a need for improved methods of superheat control in modern vapor compression refrigeration systems that can reduce operation cost and increase reliability. Therefore, an object of the present invention is to provide a system and method which overcomes the aforementioned inadequacies of the prior art systems and provides an improved system for evaporator superheat control.

SUMMARY OF THE INVENTION

The present application relates generally to heating, ventilation, air conditioning, and refrigeration (HVAC & R) equipment based on vapor compression refrigeration systems and more particularly to systems and methods for controlling superheat in a refrigeration vapor compression system independently of the metering device whether being of the thermostatic or electronic expansion type.

In various embodiments, the systems and methods provide a novel method for controlling the refrigeration system superheat and addressing various drawbacks of the refrigeration systems superheat control described in prior art. For those skilled in the art, it is known that superheat control in refrigeration system is primarily controlled by the metering device. In some embodiments, a refrigeration system is provided that includes a heat exchanger configured for when the metering device is not capable of regulating the superheat temperature at the outlet of the evaporator and fails to reach the desired conditions at the outlet of the evaporator. The heat exchanger is configured to provide superheat control for the vapor-liquid mixture or saturated vapor refrigerant flowing through a first side of a heat exchanger by absorbing heat from the high pressure high temperature superheated gas refrigerant flowing through a second side of the heat exchanger.

In general, a refrigeration system includes a compressor, a condenser, a metering device, an evaporator, and refrigerant lines fluidly connecting the compressor, the condenser, the metering device and the evaporator to form a refrigerating circuit for circulating the refrigerant. The condenser is disposed downstream of the compressor and it is used to condense the gas refrigerant. The metering device disposed downstream of the condenser controls the flow of the refrigerant liquid to the evaporator. The evaporator, disposed downstream of the metering device vaporizes the refrigerant.

In one embodiment, the refrigeration system includes a heat exchanger configured to provide superheat for the gas refrigerant flowing through a first side of the heat exchanger by absorbing heat from the high pressure high temperature superheated refrigerant flowing through the second side of the heat exchanger. A solenoid valve may be located at the inlet of the second side of the heat exchanger and configured to allow a fraction of the high temperature high pressure superheated gas refrigerant to flow through the second side of the heat exchanger. Various gas temperature sensors and gas pressure sensors are configured to measure the temperature and pressure of the gas refrigerant throughout the refrigeration system. A controller is configured to calculate the superheat of the gas refrigerant based on the measured temperature and measured pressure of the gas refrigerant and may compare the calculated superheat to a superheat threshold. If the calculated superheat is less than the superheat threshold, the controller may open the solenoid valve to a predetermined position. The controller may operate the modulating solenoid valve using a feedback technique in order to control the superheat of the refrigeration system within the set threshold.

In some embodiments, the refrigeration system includes interconnecting fluid conduits connecting the refrigerant outlet of the evaporator to the inlet of the first side of the heat exchanger. A gas temperature sensor and a gas pressure sensor are located along the fluid conduit and configured to measure the temperature and pressure of the gas refrigerant within the fluid conduit.

In some embodiments, the refrigerating system includes interconnecting fluid conduits connecting the outlet of the first side of the heat exchanger to the inlet of the compressor. A temperature sensor may be located along the fluid conduits and configured to measure the temperature of the gas refrigerant within the fluid conduit downstream of the compressor.

In some embodiments, the refrigeration systems include interconnecting fluid conduits connecting the discharge of the compressor to the inlet of the second side of the heat exchanger. A modulating solenoid valve may be configured on the fluid conduits connecting the discharge of the compressor to the inlet of the second side of the heat exchanger allowing a fraction of the high pressure high temperature superheated refrigerant to flow through the second side of the heat exchanger.

In another embodiment, a method is provided for enabling the refrigeration system to avoid tripping at high ambient temperatures in the event the condenser is not capable of rejecting the heat to the outdoor ambient air or fluid due to high ambient temperatures. A refrigeration system is provided including a solenoid valve configured to divert a fraction of the superheated high pressure high temperature gas refrigerant flowing out of the compressor to flow through a second side of the heat exchanger and reject heat to the low pressure low temperature gas refrigerant flowing through the first side of the heat exchanger.

The above summary of the invention is not intended to represent each embodiment or every aspect of the present invention. Particular embodiments may include one, some, or none of the listed advantages. Those skilled in the art will appreciate that the summary is illustrative only and does not in any way limit the current disclosure. The refrigeration systems and methods of the present disclosure have other features and advantages that will be apparent and be set forth in the accompanying drawings, which are incorporated herein, and the following Detailed Description, which together serve to explain certain principles of the present disclosure.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

Reference will now be made in detail to implementations of the present disclosure as illustrated in the accompanying drawings. Those of ordinary skill in the art will realize that the following detailed description of the current disclosure is illustrative only and is not intended in any way to be limiting. Other embodiments of the present disclosure will readily suggest themselves to such skilled persons having benefits of this disclosure.

In the interest of clarity, not all features of the present disclosure described herein are shown and described. It will, of course, be apparent to those skilled in the art that many variations of this disclosure can be made without departing from its spirit and scope. In some embodiments, the refrigeration system disclosed shares some common components with existing refrigeration systems, for instance, compressors, condensers, and evaporators. In some cases, the refrigeration systems are constructed by modifying existing A/C refrigeration systems, for instance, by installation of a superheater and/or controller into existing A/C refrigeration systems.

Various embodiments are described in the context of refrigeration systems and methods for controlling the superheat and improving the efficiency of the refrigeration system, for example, at high outdoor ambient temperatures. Various embodiments of the refrigeration system may be used in a variety of applications such as with chillers that are installed in conjunction with variable chilled water flow rates. The chillers can be of the air cooled or water cooled type and can be of the variable speed or constant speed type. Another area of application includes use with dedicated outdoor air systems (DOAS). A DOAS is a unit supplying cooled, dehumidified outside air to a building in summer and heated outside air in the winter.

Figure 1:
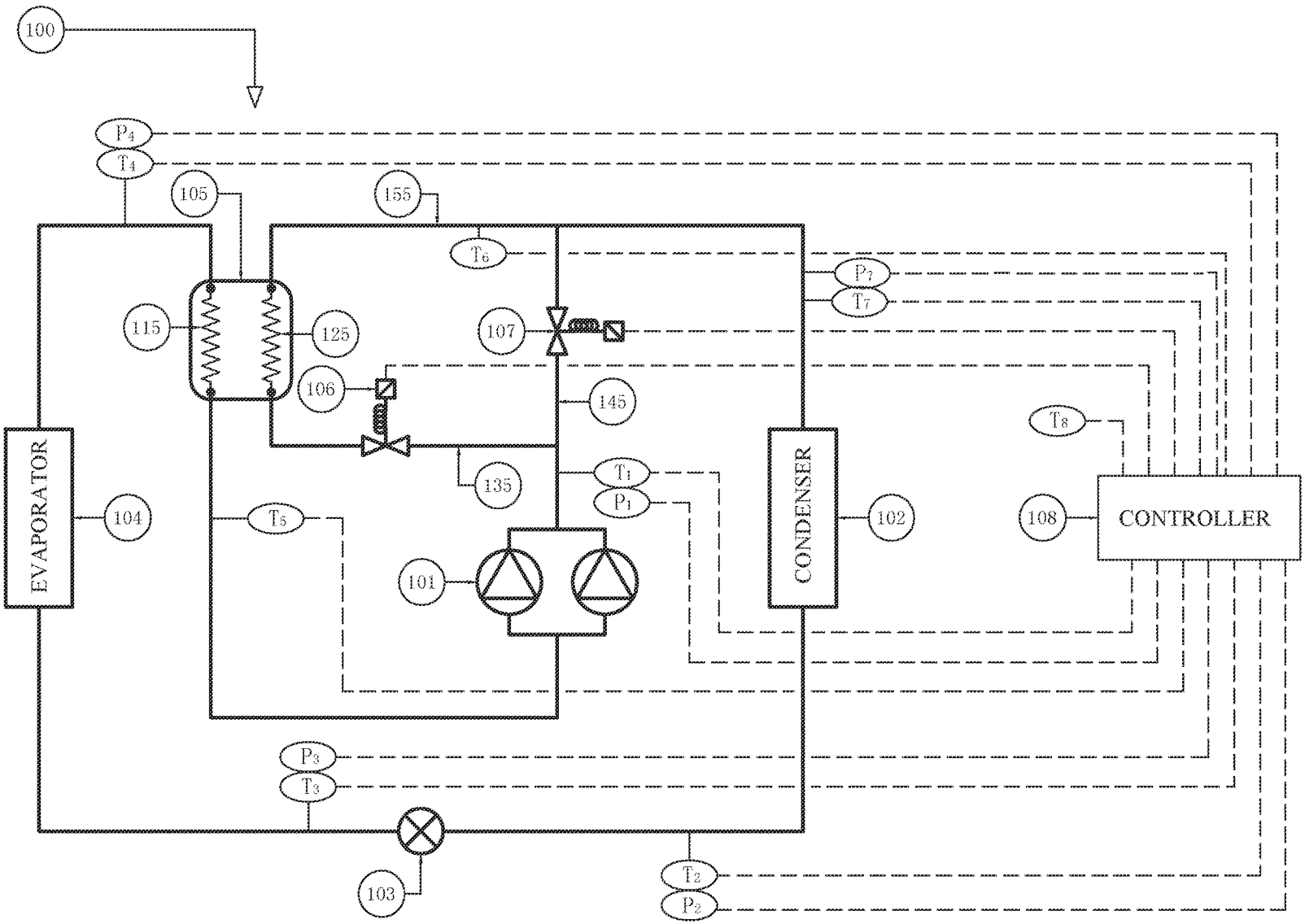
FIG. 1 is a schematic diagram of an exemplary system in accordance with the present disclosure.

Referring now to FIG. 1, a refrigeration system (100) is shown, according to an exemplary embodiment. The refrigeration system (100) comprises a compressor (101), a condenser (102), a metering device (103), an evaporator (104), an intermediary heat exchanger (105), a controller (108), a variety of sensors and control valves and refrigerant lines connecting the compressor, the condenser, the evaporator and the intermediary heat exchanger to form a refrigerant circuit.

During operation of the refrigeration system (100), the compressor (101) compresses superheated low pressure low temperature refrigerant gas from the evaporator (104) to a high temperature high pressure superheated refrigerant gas. The compressor (101) may be in the form of a centrifugal, screw, rotary, reciprocal, or scroll compressor, whether of the constant speed or variable speed type. In some embodiments, the refrigeration system (100) may include two or more compressors arranged in parallel. The high pressure high temperature superheated gas refrigerant is discharged from the compressor (101) to the condenser (102) through an interconnecting tube, such as copper or other tubing.

Condenser (102) may be a heat exchanger or other similar device for removing heat from a refrigerant. In some embodiments, the condenser (102), may be of the air cooled or water cooled type. In some embodiments, condenser (102) may include multiple condensers arranged in parallel or series with each other. Condenser (102) will transfer the heat from the superheated gas refrigerant flowing out of the compressor (101) to a secondary fluid or the surrounding air. A constant pressure or isobaric heat rejection process takes place in the condenser (102). The refrigerant gas enters the condenser (102) as a superheated high pressure high temperature refrigerant and is de-superheated, condensed and subcooled before exiting the condenser (102). The liquid refrigerant exits the condenser (102), as a subcooled liquid at high pressure. The level of subcooling is defined as the difference between the liquid refrigerant temperature leaving the condenser and the saturation temperature of the refrigerant at the given pressure. Ultimately, the condenser (102) must ensure delivery of 100% liquid refrigerant to the metering device (103). For those skilled in the art, it is should be known that a typical sub-cooling on the order of 10 degrees F. is common. In the illustrated embodiment, the sub-cooling level may be calculated by the controller (108) by subtracting the difference between the corresponding saturation temperature as measured by the pressure transducer (P2) and the subcooled refrigerant temperature measured by the temperature sensor (T2) located at the refrigerant liquid line exiting the condenser (102).

The refrigeration system (100) as illustrated in FIG. 1 includes a metering device (103) disposed upstream of the evaporator (104) and configured to control the flow of the liquid refrigerant exiting the condenser (102) and into the evaporator (104). The metering device (103) can be a thermostatic expansion valves (TXV), an electronic expansion valve (EEV), or other metering device. When the subcooled liquid refrigerant at high pressure expands through the metering device (103), the pressure and thus the saturation temperature decreases. The refrigerant is delivered to the evaporator (104) as a liquid-vapor refrigerant mixture.

Evaporator (104) is located downstream of the metering device (103) and is configured to facilitate the heat transfer from the surrounding fluid or air into the refrigerant. In some embodiments, the evaporator (104) may include multiple evaporators arranged in parallel or series with each other. In some embodiments, the evaporator (104) may be associated with liquid chillers for cooling water or any other fluid. In some embodiments, the evaporator (104) may be of the shell and tube or plate heat exchanger type or other exchanger type. The metering device (103) delivers a wet vapor refrigerant mixture to the evaporator (104) at low pressure. The reduction of pressure in the evaporator (104) causes the wet vapor refrigerant to begin boiling, absorbing heat from the fluid passing through the evaporator (104). The refrigerant continues to boil and absorb heat in the evaporator (104) until it becomes a single phase vapor at which point the vapor will continue to heat above the saturation temperature. This added heat is the superheat of the system. For those skilled in the art it is known that a typical superheat level on the order of 12 degrees F. is common. Superheat levels typically should not exceed 20 degrees F. so as not cause overheating of the compressor (101). In the illustrated embodiment, the superheat level may be calculated by the controller (108) by subtracting the difference between the temperature measured by the temperature sensor (T4) located at the refrigerant vapor line exiting the evaporator (104) and the corresponding saturation temperature as measured by the pressure transducer (P4). The superheated refrigerant vapor then flows to the inlet of the compressor (101) where the cycle begins again.

Heat exchanger (105) can be configured to superheat the wet or saturated vapor refrigerant flowing out of the evaporator (104). The heat exchanger (105) is shown to include a first side (115) and a second side (125). The first side (115) may receive wet or saturated vapor refrigerant from the evaporator (104). In some embodiments, the inlet of the second side (125) of the heat exchanger (105) is connected through an interconnecting line (135) made of copper tubing or any other tubing to the discharge of the compressor (101) in order to allow a fraction of the superheated high pressure high temperature refrigerant flowing out of the compressor (101) to flow through the second side (125) of the heat exchanger (105). A modulating solenoid valve (106) may be disposed along the interconnecting line (135) and may be configured to modulate the flow of the high pressure high temperature superheated refrigerant flowing through the second side (125) of the heat exchanger, thereby rejecting heat to the wet or saturated vapor flowing through the first side (115) of the heat exchanger (105) and accordingly providing the needed superheat to the wet or saturated vapor refrigerant prior to entering the compressor (101). An interconnecting line (145) fluidly connect the discharge of the compressor (101) to the outlet of the second side (125) of the heat exchanger (105). A modulating solenoid valve (107) may be disposed along the interconnecting line (145) and may be configured to modulate the flow of the high pressure high temperature superheated refrigerant flowing through the interconnecting line (145).

In some embodiments, the modulating solenoid valve (106) may be configured to be fully closed, and the modulating solenoid valve (107) may be configured to the be fully opened. As such, the refrigerant discharged from the compressor (101) will fully flow through the interconnecting line (145) and be delivered to the condenser (102). In some embodiments, modulating solenoid valves (106) and (107) may be a single valve disposed along the interconnecting line (135), along the interconnecting line (145), or along the interconnecting line (155) to modulate the flow of the high pressure high temperature superheated refrigerant flowing through the second side (125) of the heat exchanger (155). In some embodiments, modulating solenoid valves (106) and/or (107) may be a valve, such as, for example, a flow diverter, disposed at the junction of the interconnecting line (135) and the interconnecting line (145) and/or at the junction of the interconnecting line (155) and the interconnecting line (145) to modulate the flow of the high pressure high temperature superheated refrigerant flowing through the second side (125) of the heat exchanger (155).

In some embodiments, the refrigeration system (100) may also include a controller (108) electrically coupled to one or more components of the refrigeration system and configured to monitor and control the superheat of the refrigeration system and to prevent the refrigeration system (100) from tripping at high outdoor ambient temperatures.

Refrigeration system (100) is shown to include a variety of sensors, transducers and valves. For example, refrigeration system (100) may include a temperature sensor (T1) and a pressure transducer (P1) positioned at the discharge of the compressor (101) as illustrated in FIG. 1. The temperature sensor (T1) may be used for measuring the temperature of the high pressure high temperature superheated gas discharged from the compressor whereas the pressure transducer (P1) may be used for measuring the pressure of the high pressure high temperature superheated gas refrigerant being discharged from the compressor. In some embodiments, the measurements obtained by the temperature sensor (T1) are provided as inputs to the controller (108). Controller (108) can use the measurements obtained by temperature sensor (T1) to alert the user if the maximum allowable discharge temperature of the compressor (101) has been reached. If the measurement of the temperature sensor (T1) indicated that the temperature of the refrigerant gas at the discharge of the compressor has reached maximum allowable limits, the controller (108) may signal the refrigeration system (100) to stop operation in order to avoid serious damage to the compressor (101). The controller (108) may also be connected to a temperature sensor (T7) located upstream of the condenser (102) as illustrated in FIG. 1. In some embodiments, the measurements obtained by the temperature sensor (T7) are provided as inputs to the controller (108). The controller (108) may also be connected to the temperature sensor (T2) located downstream of the condenser and used to measure the temperature of the subcooled liquid leaving the condenser. The controller (108) may also be connected to a pressure transducer (P2) located downstream of the condenser (102). In some embodiments, the measurements obtained by the pressure transducer (P2) are provided as inputs to the controller (108). Controller (108) can use the measurements obtained by pressure transducer (P2) to extrapolate the saturation temperature of the refrigerant existing the condenser (102).

The controller (108) may also be connected to a temperature sensor (T3) and pressure transducer (P3) located downstream of the metering device as illustrated in FIG. 1. In some embodiments, the measurements obtained by the temperature sensor (T3) and pressure transducer (P3) are provided as inputs to the controller (108).

The controller (108) may also be connected to the temperature sensor (T4) located downstream of the evaporator (104) and upstream of the heat exchanger (105) and used to measure the temperature of the refrigerant gas leaving the evaporator (104). In some embodiments, the measurements obtained by the temperature sensor (T4) are provided as inputs to the controller (108). Controller (108) can use the measurements obtained by the temperature sensor (T4) in order to measure the superheat of the refrigeration system (100).

The controller (108) may also be connected to the pressure transducer (P4) located downstream of the evaporator (104) and upstream of the heat exchanger (105) and used to measure the pressure of the refrigerant gas leaving the evaporator (104). Controller (108) can use the measurements obtained by pressure transducer (P4) to extrapolate the saturation temperature of the refrigerant existing the evaporator (104).

In some embodiments, controller (108) may use the calculated superheat to control the position of the modulating solenoid valves (106) and (107). Controller (108) can variably modulate the opening or closing position of the solenoid valves (106) and (107) to regulate the flow of superheated high temperature high pressure refrigerant flowing the second side (125) of the heat exchanger (105).

The controller (108) may also be connected to a temperature sensor (T5) located on the refrigerant vapor line existing the first side (115) of the heat exchanger (105) before entering the compressor (101). The measurements from temperature sensor (T5) may be provided as inputs to the controller (108). Controller (108) can use the measurements obtained by the temperature sensor (T5) in order confirm that the desired superheat threshold of the refrigeration system have been achieved.

Refrigeration system (100) may include an ambient temperature sensor (T8) configured to measure the ambient temperature outside the condenser (102). In some embodiments, the measurements obtained by the temperature sensor (T8) or obtained from other sources are provided as inputs to the controller (108). Controller (108) can use the measurements obtained by temperature sensor (T8) to determine the differential temperature between the refrigerant in the condenser (102) and the ambient temperature. This temperature differential may have an impact on the rate of heat transfer provided by the condenser (102) and can be used by the controller (108) to operate the modulating solenoid valves (106) and (107). Refrigeration system (100) may also include a temperature sensor (T6) configured to measure the temperature of the high pressure high temperature gas refrigerant exiting second side (125) of the heat exchanger.

Figure 2:
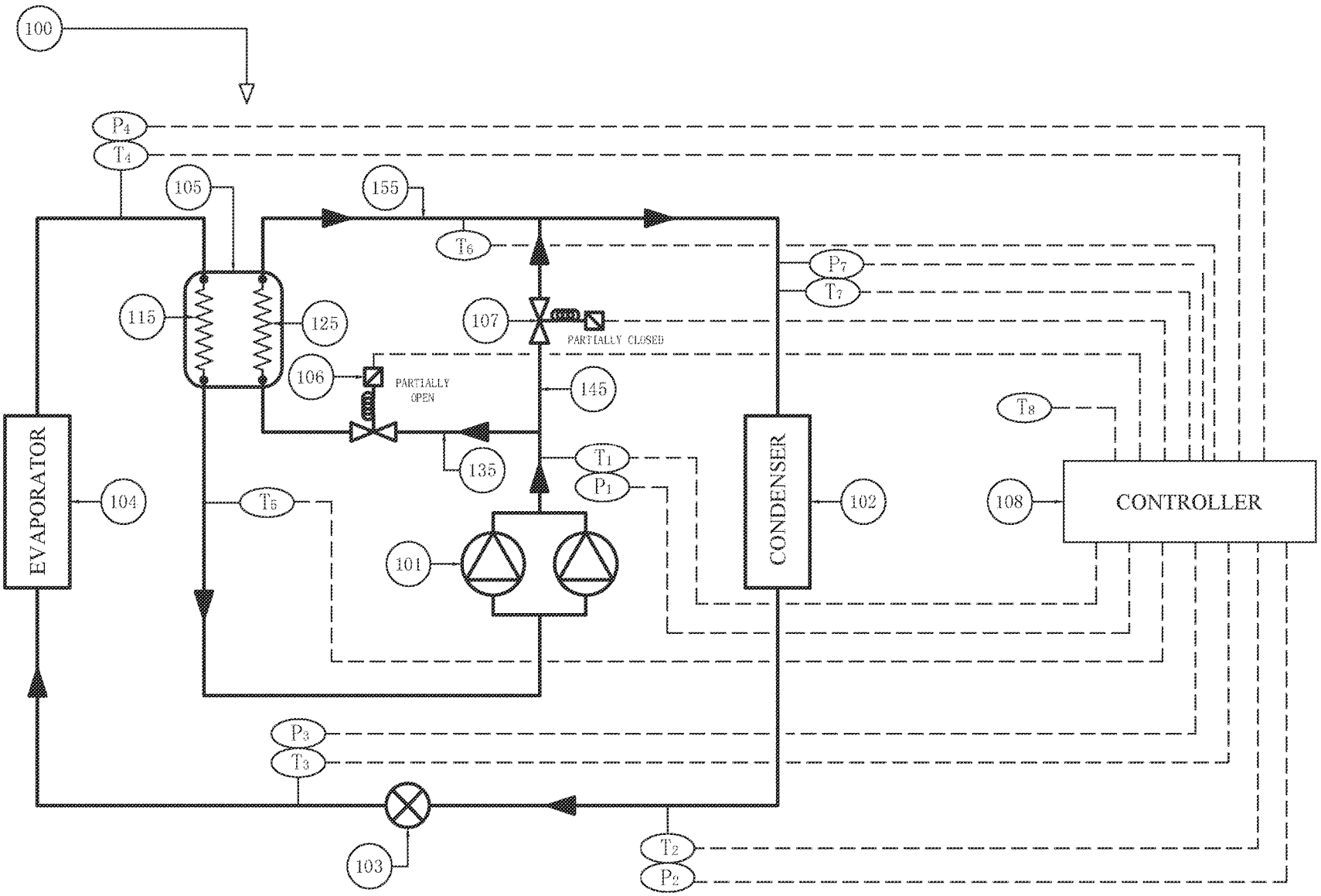
FIG. 2 is a schematic diagram of an exemplary system in accordance with the present disclosure with a superheat control priority mode.

Referring now to FIG. 2, an embodiment of a method for controlling the superheat of the refrigeration system (100) is provided. When the refrigeration system (100) is operating in the superheat priority mode, and in case the metering device (103) is not capable of maintaining the superheat of the refrigeration system within target set point tolerance, the refrigeration system (100) controller (108) will modulate the opening of the solenoid valves (106) and (107) to a calculated or predetermined position to allow a fraction of the high pressure high temperature superheated vapor discharged from the compressor (101) to flow through the second side (125) of the heat exchanger (105). During the superheat priority mode, the solenoid valve (106) will change status from fully closed to partially open depending on the signal received from the controller (108), allowing part of the refrigerant mass flow to flow through the second side (125) of heat exchanger (105). Solenoid valve (107) may also change status from fully open to partially closed to restrict the flow of the refrigerant. In various embodiments, the controller (108) may incrementally open solenoid valve (106) and/or incrementally close solenoid valve (107) using a feedback technique in order to control the superheat of the refrigeration system within the set threshold. In other embodiments, once the solenoid valve (106) is fully open and/or the solenoid valve (107) is fully closed, the controller (108) may incrementally close solenoid valve (106) and/or incrementally open solenoid valve (107) using a feedback technique.

In the heat exchanger (105), heat is exchanged between the fraction of the high pressure high temperature superheated refrigerant discharged from the compressor (101) and flowing through the second side (125) of the heat exchanger with the gas-liquid refrigerant mixtures flowing out of the evaporator (104) and flowing through the first side (115) of the heat exchanger (105). This process will continue until the desired superheat value is obtained. The confirmation that the superheat threshold is achieved will be confirmed by the readings of the temperature sensor (T5) located downstream of the first side (115) of the heat exchanger (105). If the difference between the temperature as measured by the temperature (T5) and the corresponding saturation temperature as extrapolated by the controller (108) from the input measurements of the pressure sensor (P4) is greater than or equal to the desired superheat value, then the controller (108) will signal the solenoid valves (106) and (107) to begin returning them, either completely or partially, to their original positions.

In some embodiments, for example, where superheat control is not critical to the operation of the refrigeration system (100) and/or where the outdoor ambient temperature is very high and is affecting the heat transfer process in the condenser (102) and the readings of the temperature sensor (T1) are showing that the superheated high pressure high temperature refrigerant is reaching the maximum allowable temperature limits before tripping, the controller (108) of the refrigeration system (100) may activate a high ambient operation mode. When the refrigeration system (100) is operating in the high ambient operation mode, for example, where the condenser (102) is not able to efficiently reject the refrigerant heat to the outdoor ambient air, the refrigeration system (100) controller (108) will modulate the opening of the solenoid valves (106) and/or (107) to a calculated and/or predetermined position to allow a fraction of the high pressure high temperature superheated vapor discharged from the compressor (101) to flow through the second side (125) of the heat exchanger (105). In the heat exchanger (105) heat is exchanged between the fraction of the high pressure high temperature superheated vapor discharged from the compressor (101) with the gas-liquid refrigerant mixtures flowing out of the evaporator (104) and flowing through the first side (115) of the heat exchanger (105). In various embodiments, the controller (108) may incrementally open solenoid valve (106) and/or incrementally close solenoid valve (107) using a feedback technique in order to keep the temperature below a set threshold. In other embodiments, once the solenoid valve (106) is fully open and/or the solenoid valve (107) is fully closed, the controller (108) may incrementally close solenoid valve (106) and/or incrementally open solenoid valve (107) using a feedback technique. This process may continue until the readings of the temperature sensor (T1) are within allowable limits.

Figure 3A:
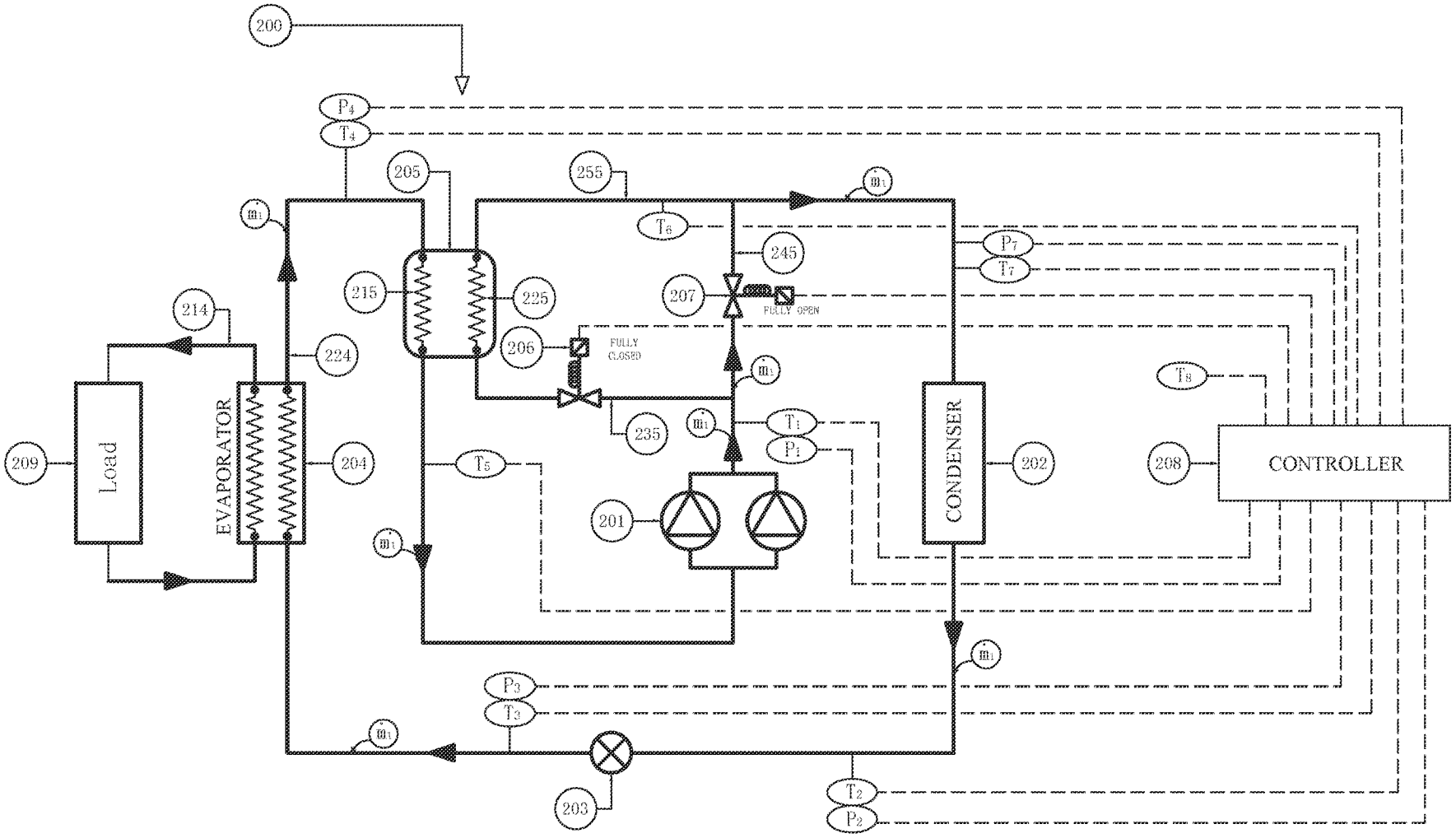
FIG. 3A is a diagram showing the flow of refrigerant within the refrigeration system during the refrigeration system start up control.
Figure 3B:
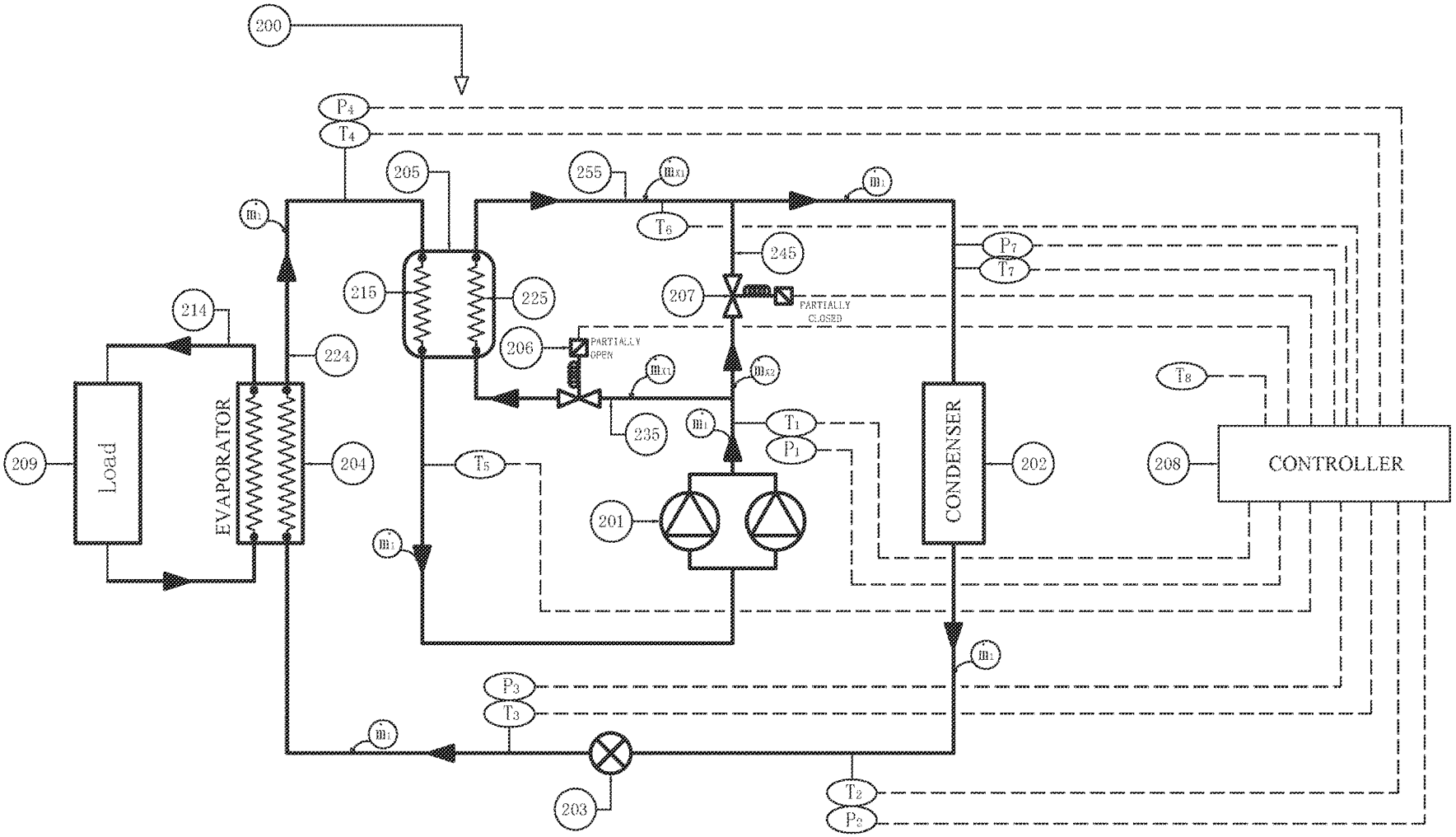
FIG. 3B is a diagram showing the flow of the refrigerant within the refrigeration system according to the current disclosure.

Referring now to FIG. 3A and FIG. 3B, there depicts a method for controlling a refrigeration system (200) connected to a variable load (209) in accordance with some embodiments. Refrigeration system (200) may be used in conjunction with an air cooled or water cooled chiller with variable fluid flow rate flowing through a first side (214) of the evaporator (204) or any other refrigeration system connected to a variable load (209).

Figure 4A:
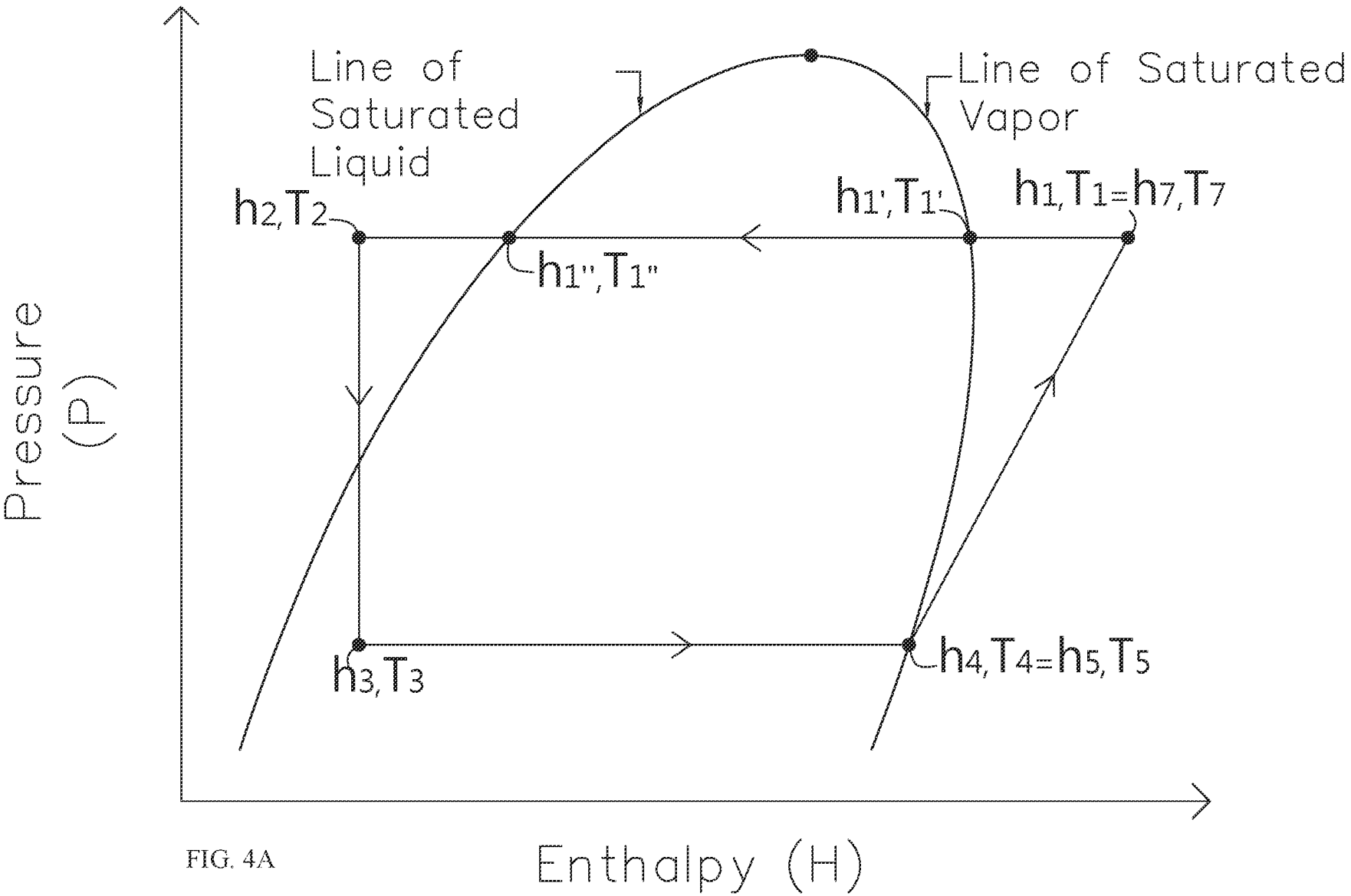
FIG. 4A is a Mollier or pressure-enthalpy diagram in explanation of the performance of the refrigeration system shown in FIG. 3A.
Figure 4B:
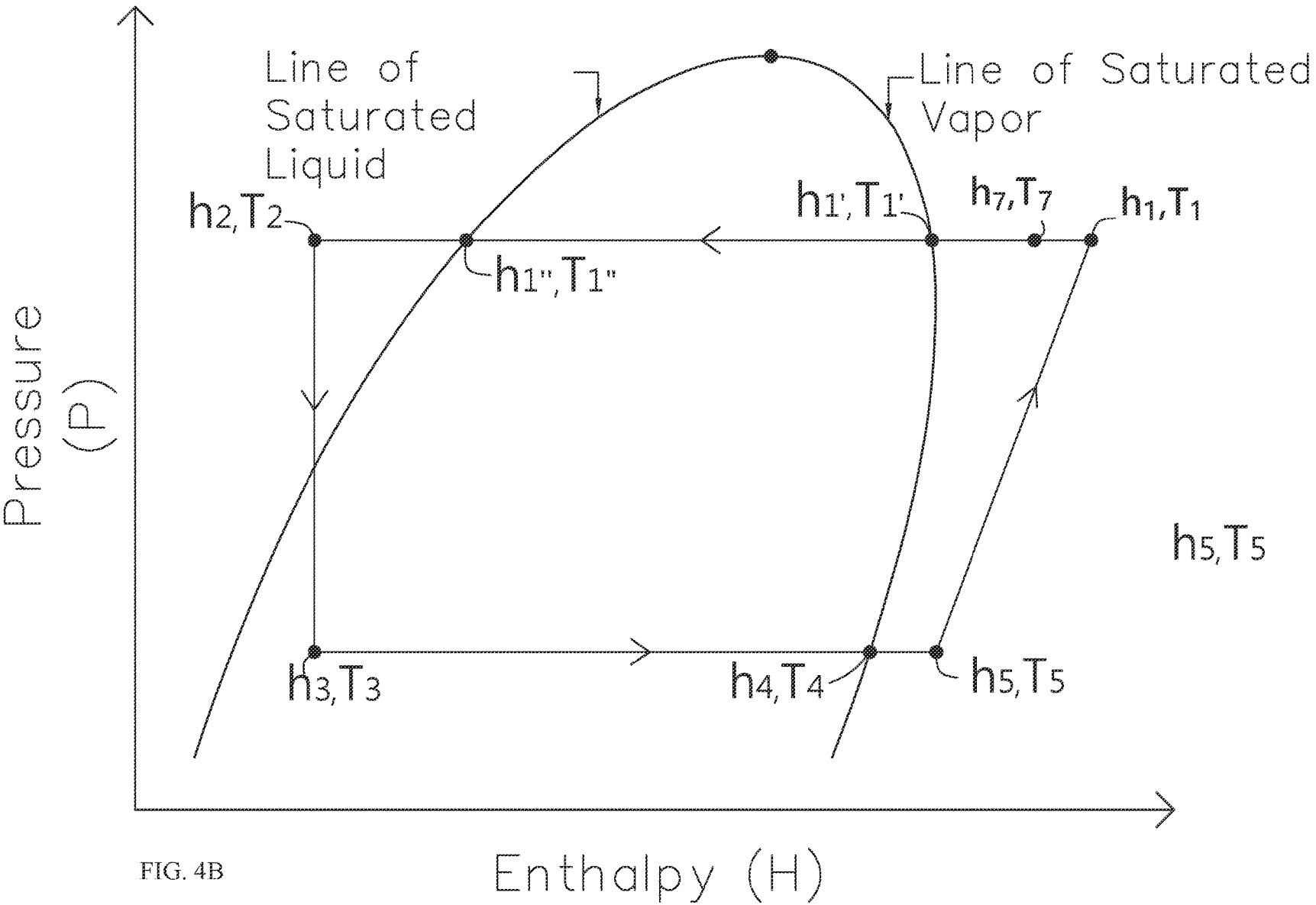
FIG. 4B is a Mollier or pressure-enthalpy diagram in explanation of the performance of the refrigeration system shown in FIG. 3B.

In order to further illustrate how superheat is controlled by the refrigeration system (200), reference will also be made to FIG. 4A and FIG. 4B which is a Mollier or pressure-enthalpy diagram in explanation of the performance of the refrigeration system (200) shown in FIG. 3A and FIG. 3B.

The refrigerant with a mass flow rate of $\dot{m}_1$ is discharged from the compressor (201) as a superheated high pressure high temperature gas with an enthalpy of $h_1$ as indicated in FIG. 4A. Referring to FIG. 3A, where the solenoid valve (206) is fully closed and the solenoid valve (207) is fully open, the superheated high pressure high temperature gas discharged from the compressor (201) will be fully discharged to the condenser (202). Subsequently, the temperature of the refrigerant measured by the temperature sensor (T7) will be equal to the temperature of the refrigerant measured by the temperature sensor (T1) and the enthalpy $h_7$ of the refrigerant associated with (P7) and (T7) will be equal to $h_1$. The superheated high pressure high temperature gas is first desuperheated in the condenser (202) at a constant pressure until it is transformed to a high pressure high temperature saturated vapor with an enthalpy of $h_{1'}$ as illustrated in FIG. 4A. The high pressure high temperature saturated refrigerant vapor undergoes a change of state from a saturated vapor to a saturated liquid through an isobaric and isothermal process within the condenser (202) with a corresponding enthalpy of $h_{1''}$. Finally, before exiting the condenser (202), the saturated high pressure high temperature saturated refrigerant vapor is further subcooled and is discharged from the condenser as a subcooled high pressure high temperature liquid with a resulting enthalpy of $h_2$. For those skilled in the art, it is worth mentioning that the heat rejected by the condenser to the surrounding fluid or air can be calculated using the following equation $\dot{Q}_{out}=\dot{m}_1(h_1-h_2)$ where $\dot{m}_1$ is the refrigerant mass flow rate flowing through the refrigeration system (200).

The high pressure high temperature subcooled liquid with an enthalpy of $h_2$ is discharged from the condenser (202) and then flows through the metering device (203). In the metering device, an isenthalpic throttling process occurs whereby the subcooled refrigerant undergoes a constant enthalpy process passing from high pressure to low pressure and exiting the metering device (203) as a wet vapor mixture with and enthalpy of $h_3$. The enthalpy $h_3$ of the wet vapor mixture existing the metering device is equal to the enthalpy $h_2$ of the subcooled liquid refrigerant exiting the condenser as shown in FIG. 4A.

The wet vapor refrigerant mixture with an enthalpy of $h_3$ then enters the second side (224) of the evaporator (204) and absorbs heat from the fluid flowing through the first side (214) of the evaporator. As the refrigerant flowing through the second side (224) of the evaporator (204) absorbs heat, the enthalpy of the wet vapor refrigerant is increased from $h_3$ to $h_4$ as illustrated in FIG. 4A. At this point, the refrigerant state is changed to saturated vapor and in some applications can no longer contribute to the cooling or heat absorption process of the refrigeration system (200). The heat absorbed by the refrigeration system (200) from the circulating fluid flowing through the first side (214) of the evaporator (204) can be calculated using the following equation $\dot{Q}_{in}=\dot{m}_1(h_3-h_4)$ where $\dot{m}_1$ is the refrigerant mass flow rate flowing through the refrigeration system (200).

Subsequently, the temperature of the refrigerant measured by the temperature sensor (T5) will be equal to the temperature of the refrigerant measured by the temperature sensor (T4) and the enthalpy $h_4$ of the refrigerant associated with (P4) and (T4) will be equal to $h_5$ as illustrated in FIG. 4A.

It is an object of this disclosure for the heat exchanger (205) to complement the function of the metering device (203) as a method for superheat control in the refrigeration system (200) and increase the enthalpy of the saturated refrigerant vapor from $h_4$ to $h_5$ as shown in FIG. 4B, and thus transforming the saturated vapor refrigerant to superheated low pressure low temperature refrigerant.

In order to superheat the low pressure low temperature saturated vapor refrigerant flowing through the first side (215) of the heat exchanger (205), the enthalpy of the saturated vapor must be increased from $h_4$ to $h_5$ as illustrated in FIG. 4B in order for the refrigerant to become a superheated low pressure low temperature gas.

The amount of heat needed to superheat the saturated vapor refrigerant from $h_4$ to $h_5$ flowing through the first side (215) of the heat exchanger (205) is calculated by the following equation 6 $\dot{Q}_{superheat1}=\dot{m}_1(h_4-h_5)$ where $\dot{m}_1$ is the refrigerant mass flow rate flowing through the refrigeration system (200).

According to the current disclosure, the heat required to superheat the saturated vapor refrigerant from $h_4$ to $h_5$ will be made available by transferring some of the heat available in the high pressure high temperature refrigerant with an enthalpy of $h_1$ being discharged from the compressor (201).

By modulating the position of the of the valve (207) from fully open to partially closed and the valve (206) from fully closed to partially open, we will allow a fraction $\dot{m}_{x1}$ of the refrigerant mass flow rate $\dot{m}_1$ to flow through the second side (225) of the heat exchanger (205). The remaining refrigerant mass flow rate $\dot{m}_{x2}$ will flow through the interconnecting tubing (245) connecting the discharge of the compressor (201) and outlet of the second side (225) of the heat exchanger (205).

The temperature $T_{x1}$ and enthalpy $h_{x1}$ of the refrigerant mass flow rate $\dot{m}_{x1}$ flowing into the second side (225) of the heat exchanger (205) will be equal to the temperature (T1) and enthalpy $h_1$ of the superheated high pressure high temperature refrigerant being discharged from the compressor (201). The heat transferred through the second side (225) of the heat exchanger (205) can be calculated by the following equation $\dot{Q}_{superheat2}=\dot{m}_{x1}(h_{x1}-h_6)$.

Figure 5A:
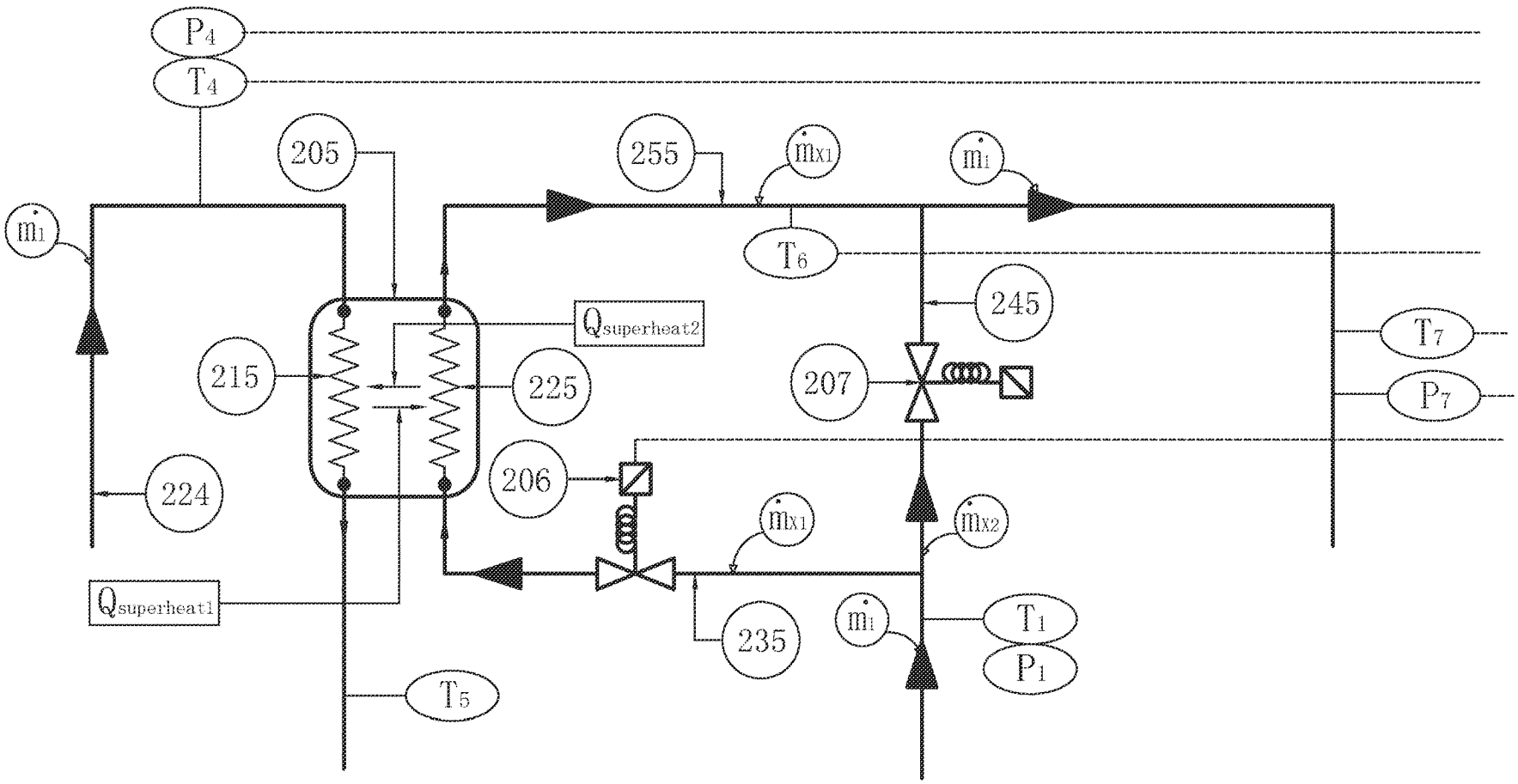
FIG. 5A is an enlarged view of the heat exchanger showing the heat transfer between the two sides of the heat exchanger.

Subsequently, the heat absorbed by the refrigerant flowing through the first side (215) of the heat exchanger (205) and the heat rejected by the fraction of the refrigerant $\dot{m}_{x1}$ flowing through the second side (225) of the heat exchanger (205) will be equal, whereby $\dot{Q}_{superheat1}=\dot{Q}_{superheat2}$ as shown in FIG. 5A.

Figure 5B:
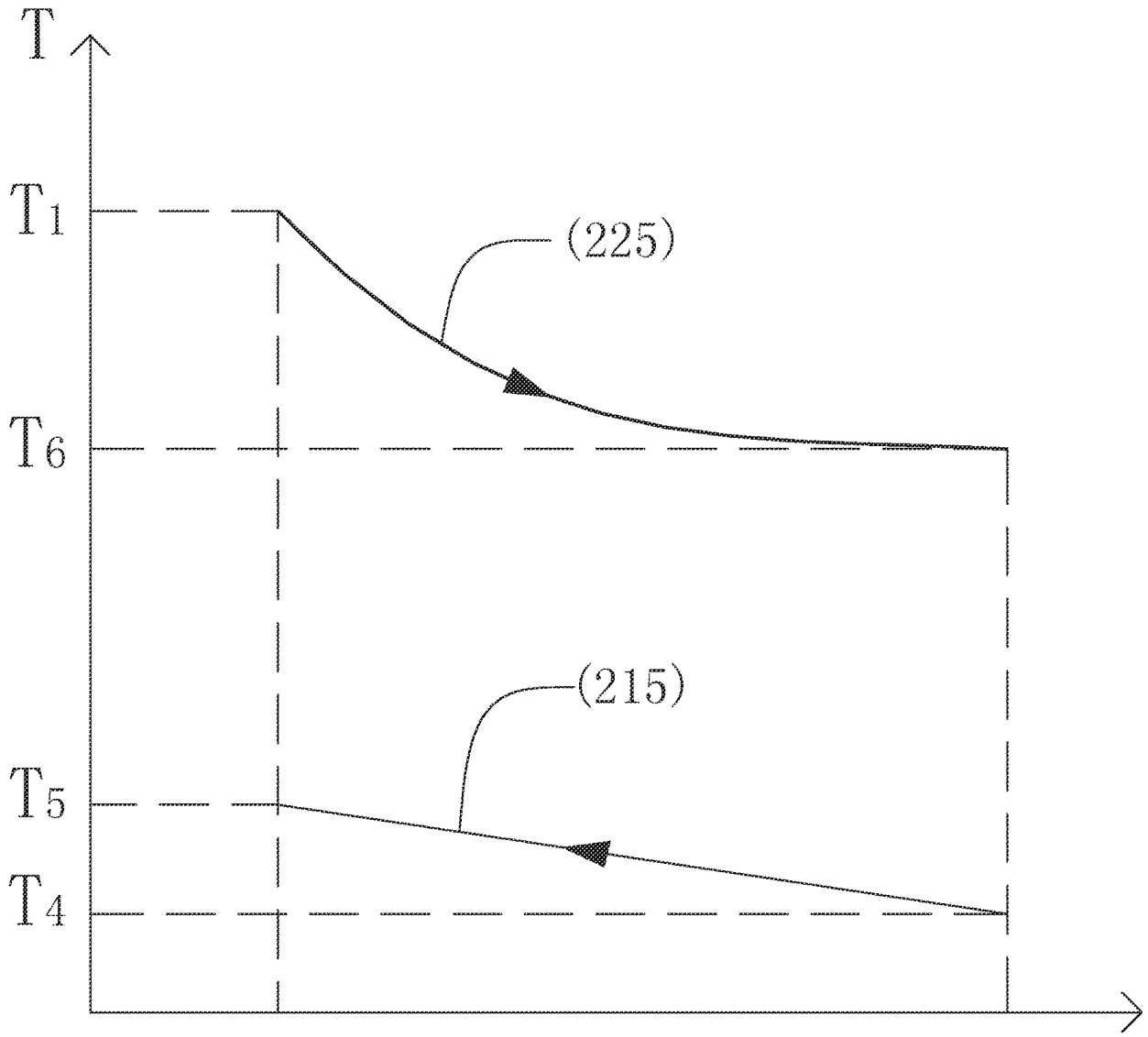
FIG. 5B is a logarithmic mean temperature difference (LMTD) diagram for the heat exchange process within the heat exchanger.

As a direct consequence of the above, the temperature and enthalpy $h_6$ of the refrigerant mass flow rate $\dot{m}_{x1}$ flowing out of the second side (225) of the heat exchanger (205) will be decreased as illustrated in FIG. 5B.

Prior to entering the condenser (202), and in order to ensure conservation of the refrigerant mass flow rate $\dot{m}_1$ throughout the refrigeration system (200), the refrigerant mass flow rate $\dot{m}_{x1}$ flowing out of the second side (225) of the heat exchanger (205) with an enthalpy of $h_6$ will be added to the refrigerant mass flow rate $\dot{m}_{x2}$ flowing through the interconnecting tubing (245) connecting the discharge of the compressor (201) and outlet of the second side (225) of the heat exchanger (205).

Consequently, the temperature and enthalpy $h_7$ of the high pressure high temperature superheated refrigerant as measured by the temperature sensor (T7) flowing into the condenser will be lower than the temperature (T1) and enthalpy $h_1$ of the superheated high pressure high temperature refrigerant being discharged from the compressor (201).

When the difference between the temperature as measured by the temperature (T5) and the corresponding saturation temperature as extrapolated by the controller (208) from the input measurements of the pressure sensor (P4) is greater than or equal to the desired superheat value, then the controller (208) will signal the solenoid valves (206) and (207) to begin returning to their original positions.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention.

What is claimed is:

1. A refrigeration system comprising:

a main refrigerant circuit comprising:

a compressor for receiving a refrigerant flowing in the main refrigerant circuit and outputting a high temperature high pressure superheated refrigerant;

a condenser coupled to an outlet of the compressor and configured to subcool the high temperature high pressure superheated refrigerant;

a metering device coupled to an outlet of the condenser and configured to expand the subcooled refrigerant exiting the condenser;

an evaporator coupled to an outlet of the metering device and configured to transfer heat into the expanded refrigerant; and a first side of a heat exchanger disposed between an outlet of the evaporator and an inlet of the condenser;

a bypass refrigerant circuit comprising a second side of the heat exchanger, wherein a first bypass fluid conduit couples an inlet of the second side of the heat exchanger to the main fluid conduit and a second bypass fluid conduit couples an outlet of the second side of the heat exchanger to the main fluid conduit;

one or more control valves coupled to the outlet of the compressor for diverting at least a portion of the high temperature high pressure superheated refrigerant from the main refrigerant circuit to the bypass refrigerant circuit;

wherein the heat exchanger is configured to provide superheat control by transferring heat from the high pressure high temperature superheated refrigerant flowing through the second side of the heat exchanger to the refrigerant flowing from the evaporator to the compressor via the first side of the heat exchanger; and a controller configured to calculate a superheat of the refrigerant flowing from the evaporator to the compressor and causing the one or more control valves to divert at least a portion of the high temperature high pressure superheated refrigerant from the main refrigerant circuit to the bypass refrigerant circuit when the calculated superheat is less than a superheat threshold.

2. The refrigeration system according to claim 1, wherein the heat exchanger is a plate heat exchanger arranged in a counter flow pattern.

3. The refrigeration system of claim 1, wherein diverting the high temperature high pressure superheated refrigerant from the main refrigerant circuit to the bypass refrigerant circuit ensures the refrigerant received at the inlet of the compressor is a gas.

4. The refrigeration system of claim 1, wherein the one or more control valves comprise a first control valve located in the bypass fluid circuit, and a second control valve located in the main fluid conduit between the first bypass fluid conduit and the second bypass fluid conduit.

5. The refrigeration system of claim 1, wherein the controller is configured to monitor the superheat and operate the one or more control valves using a feedback control technique to drive a temperature of the refrigerant received by the compressor to a superheat temperature set point.

6. A refrigeration system comprising:

a condenser coupled to an evaporator to form a refrigerant circuit;

an expansion valve located in the refrigerant circuit between an outlet of the condenser and an inlet of the evaporator;

a compressor located in the refrigerant circuit between an inlet of the condenser and an outlet of the evaporator;

a heat exchanger located in the refrigerant circuit and configured to provide superheat control for a refrigerant flowing through a first side of the heat exchanger by absorbing heat from a high pressure high temperature superheated refrigerant flowing through a second side of the heat exchanger;

wherein the first side of the heat exchanger is located between an inlet of the compressor and the outlet of the evaporator and the second side of the heat exchanger is located between an outlet of the compressor and the inlet of the condenser;

a control valve located in the refrigerant circuit downstream of the outlet of the compressor and configured to divert at least a portion of the high pressure high temperature superheated refrigerant exiting the compressor towards the second side of the heat exchanger;

a controller configured to calculate a superheat of the refrigerant exiting the evaporator and to operate the control valve to divert at least a portion of the high pressure high temperature superheated refrigerant exiting the compressor towards the second side of the heat exchanger when the calculated superheat is less than a superheat threshold.

7. The refrigeration system according to claim 6, wherein the controller is configured to operate the control valve using a feedback control technique to drive the superheat to a superheat set point.

8. The refrigeration system according to claim 6, wherein the heat exchanger is a plate heat exchanger arranged in a counter flow pattern.

9. The refrigeration system of claim 6, wherein diverting the high temperature high pressure superheated refrigerant towards the second side of the heat exchanger ensures the refrigerant received at the inlet of the compressor is a gas.

10. The refrigeration system of claim 6, wherein the evaporator is coupled to a variable flow chilled water system.

11. The refrigeration system of claim 6, wherein the heat exchanger increases efficiency of a refrigeration cycle by decreasing a temperature of superheated vapor flowing to the inlet of the condenser to increase a rate of heat rejection by the condenser.

12. The refrigeration system of claim 6, wherein diverting the high temperature high pressure superheated refrigerant towards the second side of the heat exchanger allows the refrigeration system to be more efficient at high ambient temperatures.

* * * * *